United States Patent [19]

Moore, Jr.

[11] 4,254,372

[45] Mar. 3, 1981

[54] SERIES PASS VOLTAGE REGULATOR WITH OVERCURRENT PROTECTION

[75] Inventor: Chester A. Moore, Jr., Kokomo, Ind.

[73] Assignee: General Motors Corporation, Detroit, Mich.

[21] Appl. No.: 13,141

[22] Filed: Feb. 21, 1979

[51] Int. Cl.[3] ..... G05F 1/58

[52] U.S. Cl. ..... 323/277; 323/280; 361/18

[58] Field of Search ..... 323/9, 22 T, 4, 17, 323/DIG. 1; 361/18

[56] References Cited

U.S. PATENT DOCUMENTS

| | | | |
|---|---|---|---|
| 3,445,751 | 5/1969 | Easter | 323/9 |
| 3,546,566 | 12/1970 | Marzolf | 323/22 T |
| 3,629,622 | 12/1971 | Denenberg, Jr. | 323/9 X |
| 3,736,469 | 5/1973 | Baugher et al. | 323/9 X |
| 3,845,405 | 10/1974 | Leidich | 361/18 |
| 3,924,158 | 12/1975 | Farnsworth | 323/9 X |
| 4,176,309 | 11/1979 | Schulz et al. | 323/4 |

*Primary Examiner*—William M. Shoop
*Assistant Examiner*—Peter S. Wong
*Attorney, Agent, or Firm*—Howard N. Conkey

[57] ABSTRACT

A series pass voltage regulator compares the output voltage with a reference voltage and adjusts the base bias of a PNP series pass transistor coupled between an unregulated voltage source and a load to maintain the output voltage at a predetermined constant value. A current sensing resistor senses the base current of the PNP series pass transistor and limits the base current to a predetermined value indicative of a maximum allowable load current.

3 Claims, 1 Drawing Figure

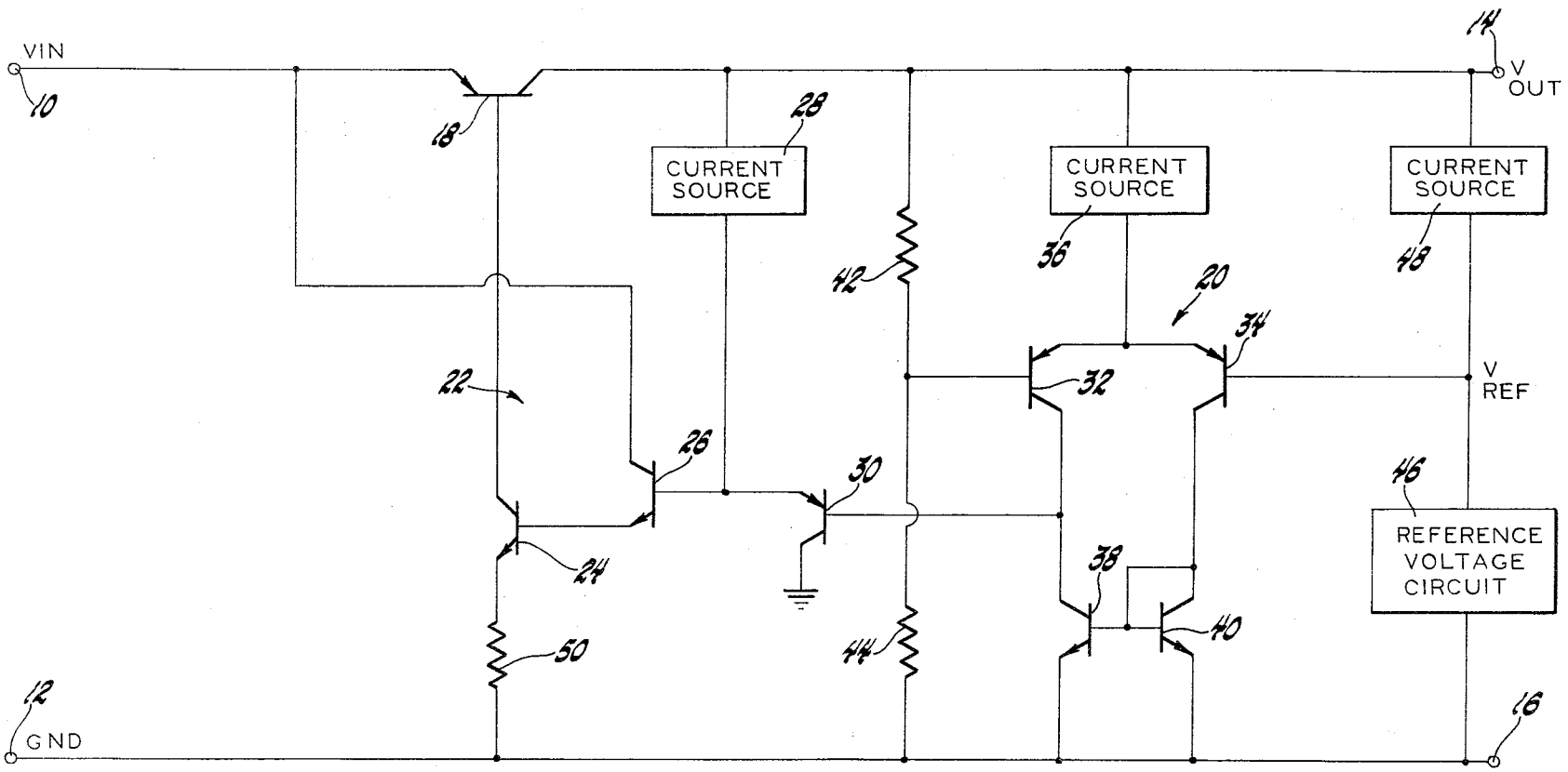
VIN
10
V OUT
14
CURRENT SOURCE
48
CURRENT SOURCE
36
CURRENT SOURCE
28
V REF
REFERENCE VOLTAGE CIRCUIT
46
16
GND
12
18
22
20
34
32
26
24
30
42
44
40
38
50

SERIES PASS VOLTAGE REGULATOR WITH OVERCURRENT PROTECTION

This invention is directed toward a series pass voltage regulator having overcurrent protection.

One form of voltage regulator widely used for providing a regulated voltage over a wide range of load currents is the series type regulator wherein a series pass transistor has its emitter and collector electrodes coupled between a source of unregulated voltage and the load. The base electrode bias is controlled in accord with the sensed output voltage to vary the load current to maintain a constant output voltage. However, in this form of regulator, large load currents result in high power dissipation in the series pass transistor. If the load current through the series pass transistor were permitted to increase uncontrolled, the series pass transistor could be destroyed.

Generally, these voltage regulators are protected from overcurrent conditions by providing a load current sensing resistor coupled in series with the collector-emitter electrodes of the series pass transistor. When the voltage across the current sensing resistor reaches a predetermined value representative of a predetermined maximum allowable load current, the base drive of the series pass transistor is limited or reduced before it can be damaged.

The use of the aforementioned load current sensing resistor may be undesirable in some applications as a result of the additional power dissipation in the current sensing resistor. Additionally, some voltage regulators are required to have a small input-output differential voltage characteristic. Since a load current sensing resistor is series coupled with the series pass transistor, the voltage developed thereacross undesirably increases the input-output differential voltage.

It is the general object of this invention to provide for an improved overcurrent protection circuit for a series pass voltage regulator.

It is another object of this invention to provide for overcurrent protection for a series pass voltage regulator which does not employ a current sensing resistor in series with the series pass transistor.

It is another object of this invention to limit the load current in a series pass transistor voltage regulator by monitoring and limiting the base electrode current of the series pass transistor.

The invention may be best understood by reference to the single FIGURE drawing which is a schematic diagram of a PNP series pass voltage regulator incorporating the overcurrent protection of this invention.

Referring to the drawing, a series pass voltage regulator is illustrated having a pair of input terminals 10 and 12 adapted for connection across an external, unregulated voltage source (not shown). The terminal 10 is coupled to the positive side of the voltage source and the terminal 12 is coupled to the grounded negative side of the voltage source. The voltage regulator also includes a pair of output terminals 14 and 16 adapted to be connected across an external load, the output terminal 16 being at ground potential.

The voltage regulating element is comprised of a series pass PNP transistor 18 whose emitter and collector electrodes are coupled between the input and output terminals 10 and 14. A regulated voltage is maintained across the output terminals 14 and 16 by closed loop adjustment of the base electrode current of the series pass transistor 18.

Control of the series pass transistor 18 is accomplished by means of a differential amplifier 20 which provides an output to an amplifier 22 that is a function of the difference between the actual output voltage across the terminals 14 and 16 and a desired regulated voltage value. The amplifier 22 adjusts the base current of the transistor 18 in accord with the output of the differential amplifier 20 to provide the regulated voltage at the output terminal 14.

The amplifier 22 includes an NPN transistor 24 coupled between the base electrode of the series pass transistor 18 and ground and an NPN transistor 26 whose emitter is coupled to the base of the transistor 24 and whose collector is coupled to the positive terminal of the external unregulated voltage source via the input terminal 10.

The amplifier 22 is driven by a current source 28 coupled between the base of the transistor 26 and the output terminal 14. The amplifier 26 is normally biased conductive by the current source 28 to provide maximum bias current for the transistor 18. The transistor 18 is then controlled to maintain the desired regulated output voltage by variably shunting the drive current to the amplifier 22 from the current source 28 to ground. This is accomplished by a PNP transistor 30 coupled between the current source 28 and ground and which is controlled by the output of the differential amplifier 20 in accord with the sensed output voltage across the terminals 14 and 16.

The differential amplifier 20 includes a pair of PNP transistors 32 and 34 whose emitters are supplied with current via a current source 36 coupled with the output terminal 14 and whose collectors are coupled to ground through a current mirror comprised of NPN transistors 38 and 40. The output voltage of the regulator across the terminals 14 and 16 is sensed by a voltage divider comprised of resistors 42 and 44 with the sensed voltage being applied to the base electrode of the transistor 32. A reference voltage is applied to the base electrode of the transistor 34 by a reference voltage circuit 46 which is supplied with current via a current source 48 coupled to the output terminal 14.

The reference voltage circuit 46 may take the form of a standard band gap circuit that generates a reference voltage of approximately 1.2 volts. The values of the resistors 42 and 44 are selected so that the voltage applied to the base of the transistor 32 is equal to the reference voltage provided by the circuit 46 when the output voltage across the terminals 14 and 16 is at the desired regulated voltage level.

The output of the differential amplifier 20 at the collector of the transistor 38 controls the bias of the transistor 30 so as to variably control the current from the current source 28 that is shunted to ground. The bias current to the amplifier 22 is thereby adjusted to control the base bias of the series pass transistor 18 in a sense tending to maintain the desired regulated voltage at the terminal 14.

The operation of the series pass voltage regulator is as follows: When the output voltage at terminal 14 increases above the desired value, the bias current for the transistor 30 from the output of the differential amplifier 20 increases to increase the amount of current shunted from the current source 28 to ground through the transistor 30. The amplifier 22 then conducts less base drive current for the series pass transistor 18 whose conduction is thereby reduced to decrease the output voltage of the regulator. When the output voltage at terminal 14 decreases to below the desired value, the output of the differential amplifier 20 decreases the bias current for the transistor 30 to increase the drive current for the amplifier 22. Consequently, the base current of the series pass transistor is increased to increase the output voltage to the desired regulated value.

The overcurrent protection of this invention takes advantage of the fact that the collector to base current amplification factor beta of the transistor 18 is known or can be determined so that its base current can be a measure of the load current. In accord with this invention, overcurrent protection is accomplished by limiting the transistor 18 base drive current to a value that is indicative of the maximum allowable load current through the transistor 18.

A current sensing resistor 50 is provided in the emitter circuit of the transistor 24 so that the voltage thereacross is a measure of the base current of the transistor 18. In this embodiment, the voltage across the resistor 50 and consequently the transistor 18 base current is limited when the voltage across the resistor 50 plus the base-emitter voltage drops of the transistors 24 and 26 minus the emitter-base voltage of the transistor 30 is great enough to forward bias the collector-base diode of the transistor 32. When this condition exists, current from the current source 28 is shunted to ground through the emitter-base diode of the transistor 30, the collector-base diode of the transistor 32 and the resistor 44 to thereby limit further increases in the voltage across the current sensing resistor 50. In this manner, the current through the current sensing resistor 50 amd consequently the base drive current of the series pass PNP transistor 18 is limited to the value producing the voltage across the current sensing resistor 50 at which the collector-base diode of the transistor 32 becomes forward biased.

By proper selection of the value of the resistor 50, the current limiting is caused to be initiated when the base current of the transistor 18 attains a value indicative of the maximum allowable load current through the transistor 18. The load current (collector current of the transistor 18) is thereby limited when the voltage across the resistor 50 is substantially equal to the maximum allowable load current through the transistor 18 divided by the current amplification factor beta of the transistor 18 multiplied by the resistance of the current sensing resistor 50.

While in the embodiment described the base drive current of the PNP pass transistor 18 and consequently the load current is limited by shunting the drive current to the amplifier 22 to ground through the collector-base diode of the transistor 32 when the voltage across the current sensing resistor 50 attains a predetermined value, the drive current of the amplifier 22 may be shunted to ground by means of a separate circuit that may include a series of diodes coupled between the base of the transistor 26 and ground and which conduct when the voltage across the current sensing resistor 50 attains a value representative of the maximum allowable load current through the transistor 18.

As can be seen from the circuit, the current sensing resistor 50 does not sense the load current directly but senses only a small current value that is less than the load current determined by the beta of the transistor 18. This provides for substantially less power dissipation in the current sensing resistor and further provides for a lower input to output voltage drop of the series pass regulator.

The description of a preferred embodiment for the purposes of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A voltage regulator having overcurrent protection comprising, in combination:

an input terminal adapted for connection to an unregulated voltage source;

an output terminal adapted for connection to a load;

a series pass transistor having base, emitter and collector electrodes, the emitter and collector electrodes being coupled between the input and output terminals for regulating the voltage at the output terminal;

means effective to provide a fixed reference voltage related to a desired regulated voltage at the output terminal;

an amplifying circuit responsive to the reference voltage and the voltage at the output terminal effective to control the current through the base electrode to a value producing substantially the desired regulated voltage at the output terminal, the base electrode current having a value that is indicative of the current supplied to the load through the series pass transistor;

a current sensing resistor series coupled with the base electrode, the current sensing resistor having a voltage thereacross that is a measure of the base electrode current and being indicative of the current supplied to the load through the series pass transistor; and means responsive to the magnitude of the voltage across the current sensing resistor effective to limit the current through the base electrode of the series pass transistor to a predetermined value indicative of a maximum allowable current through the series pass transistor to thereby provide overcurrent protection.

2. A voltage regulator having overcurrent protection comprising, in combination:

an input terminal adapted for connection to an unregulted voltage source;

an output terminal adapted for connection to a load;

a series pass transistor having base, emitter and collector electrodes, the emitter and collector electrodes being coupled between the input and output terminals for regulating the voltage at the output terminal, the series pass transistor having a current amplification factor beta;

means effective to provide a fixed reference voltage related to a desired regulated voltage at the output terminal;

an amplifying circuit responsive to the reference voltage and the voltage at the output terminal effective to control the current through the base electrode to a value producing substantially the desired regulated voltage at the output terminal, the base electrode current having a value that is equal to the collector electrode current divided by the current amplification factor beta;

a current sensing resistor series coupled with the base electrode, the current sensing resistor having a voltage thereacross that is a measure of the base electrode current; and means effective to limit the current through the base electrode of the series pass transistor when the voltage across the current sensing resistor is substantially equal to the maximum allowable collector electrode current divided by the current amplification factor beta multiplied by the resistance of the current sensing resistor to thereby provide overcurrent protection.

3. A voltage regulator having overcurrent protection comprising, in combination:

an input terminal adapted for connection to an unregulated voltage source;

an output terminal adapted for connection to a load;

a series pass transistor having base, emitter and collector electrodes, the emitter and collector electrodes being coupled between the input and output terminals for regulating the voltage at the output terminal, the current to the load being directly related to the base electrode current;

a current responsive amplifier effective to adjust the base electrode current of the series pass transistor in direct relationship with drive current supplied thereto;

means effective to provide a fixed reference voltage related to a desired regulated voltage at the output terminal;

a sensing circuit effective to sense the voltage at the output terminal and provide a voltage having a value directly proportional to the sensed voltage and equal to the fixed reference voltage when the sensed voltage at the output terminal is equal to the desired regulated voltage;

circuit means effective to compare the fixed reference voltage and the voltage provided by the sensing circuit and provide drive current to the current responsive amplifier having a value that is inversely related to the voltage provided by the sensing circuit;

a current sensing resistor series coupled with the base electrode, the voltage across the current sensing resistor being a measure of the base electrode current and being indicative of the current supplied to the load through the series pass transistor; and means responsive to the voltage across the current sensing resistor effective to limit the drive current to the current responsive amplifier when the magnitude of the voltage across the current sensing resistor represents a base electrode current indicative of a maximum allowable current through the series pass transistor to thereby provide overcurrent protection.

* * * * *